United States Patent [19]

Schema

[11] Patent Number: 4,658,473

[45] Date of Patent: Apr. 21, 1987

[54] CONCEALED FREEZER HINGE

[75] Inventor: Anthony C. Schema, Faribault, Minn.

[73] Assignee: Truth Incorporated, Owatonna, Minn.

[21] Appl. No.: 812,747

[22] Filed: Dec. 23, 1985

[51] Int. Cl.[4] ..... E05F 1/08

[52] U.S. Cl. ..... 16/290; 16/289; 16/286; 16/379; 16/382

[58] Field of Search ..... 16/286, 289–290, 16/378, 382, 379

[56] References Cited

U.S. PATENT DOCUMENTS

| | | | |
|---|---|---|---|
| 1,861,277 | 5/1932 | Kjolseth . | |
| 2,200,439 | 5/1940 | Atwood . | |
| 2,257,791 | 10/1941 | Edmister . | |
| 2,279,992 | 4/1942 | Jackson et al. . | |
| 2,479,437 | 8/1949 | Vigmostad et al. | 16/289 |
| 2,612,651 | 10/1952 | Roethel . | |
| 2,617,144 | 11/1952 | Stearns et al. . | |
| 2,726,914 | 12/1955 | Allen . | |
| 2,822,567 | 2/1958 | McCreary | 16/289 |
| 2,908,934 | 10/1959 | Ragsdale . | |
| 3,203,575 | 8/1965 | Anderson et al. . | |
| 3,209,392 | 10/1965 | Levine | 16/289 |
| 3,224,036 | 12/1965 | Himes | 16/289 |
| 3,327,427 | 6/1967 | Cornelius . | |
| 3,335,524 | 8/1967 | Carson . | |
| 3,414,933 | 12/1968 | Gronbach . | |
| 3,452,388 | 7/1969 | Stone . | |
| 3,737,947 | 6/1973 | Little | 16/290 |
| 3,810,275 | 5/1974 | Smith . | |
| 3,906,587 | 9/1975 | Little . | |
| 3,950,819 | 4/1976 | Little . | |
| 4,091,502 | 5/1978 | Little | 16/289 X |
| 4,185,415 | 1/1980 | LaConte . | |
| 4,312,097 | 1/1982 | Boyd . | |
| 4,430,770 | 2/1984 | Niekrasz et al. . | |

*Primary Examiner*—Nicholas P. Godici
*Assistant Examiner*—Carmine Cuda
*Attorney, Agent, or Firm*—Wood, Dalton, Phillips, Mason & Rowe

[57] ABSTRACT

A concealed hinge between the lid and chest of a freezer has a hook shaped support bracket with a leg and bight. The bracket leg is mounted within one wall of the chest and the bight defines substantially diametrically opposed first and second pivots. A mounting structure is provided to pivotably secure the lid to the first pivot of the support bracket. A fixed point is defined within the lid and a compression spring member is provided between the fixed point and the second pivot of the bracket. The bracket leg is mounted within the chest wall by plastic components which function as a thermal barrier.

12 Claims, 7 Drawing Figures

FIG. 5
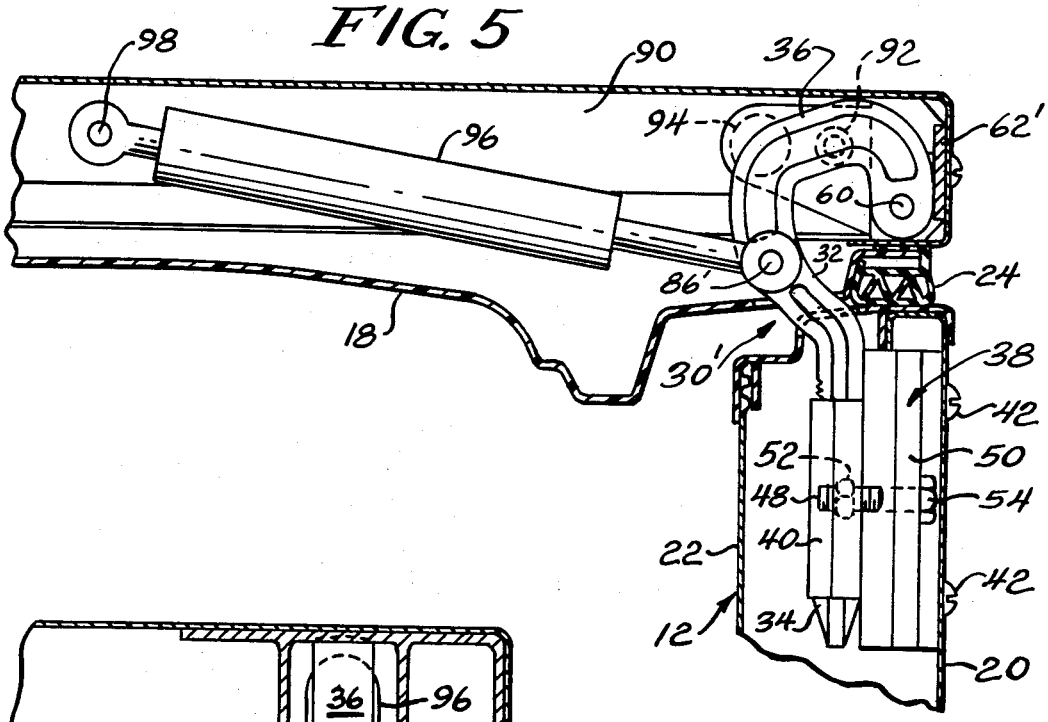
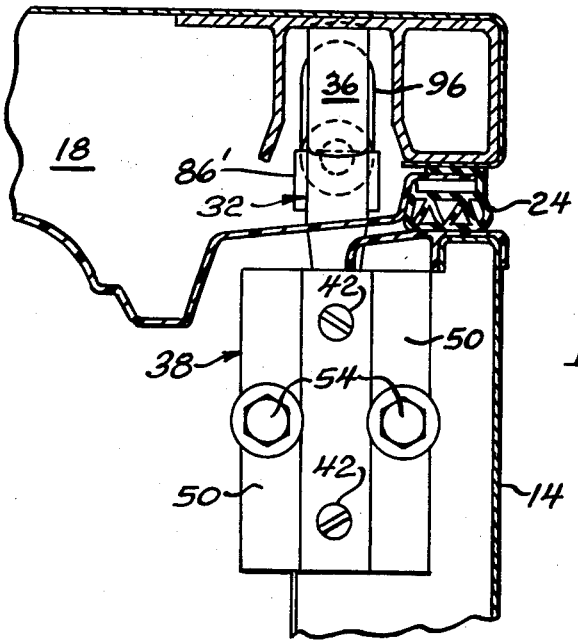
FIG. 6
FIG. 7
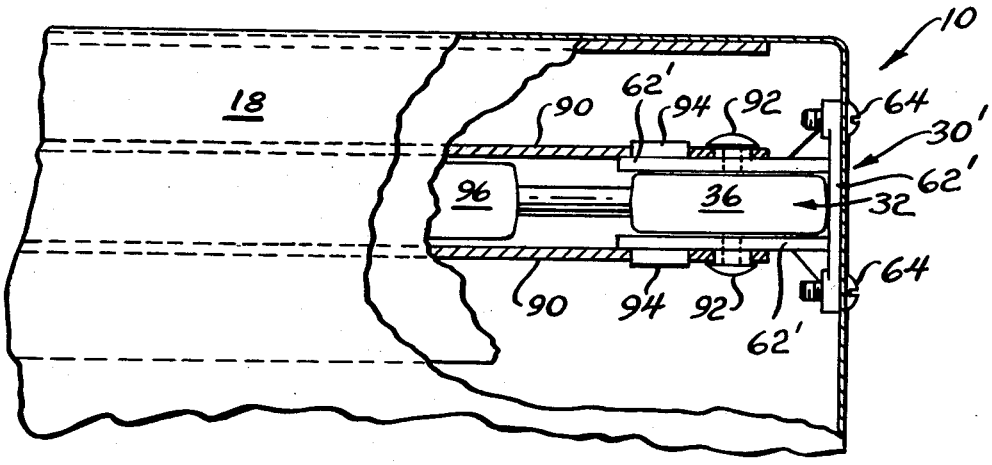

CONCEALED FREEZER HINGE

DESCRIPTION

Technical Field

This invention relates to hinges and more particularly to concealed freezer hinges.

Background Art

Numerous hinges for lids of various constructions are, of course, found in the prior art. Of these, many have been of a type which are mounted on the outside of the unit. Particularly when the unit is a home freezer, such externally mounted hinges give rise to a number of problems. Often, such hinges must be removed in order to fit the freezer through doorways in a home. Removing hinges which are under pressure can be dangerous. Further, external hinges require that the freezer be positioned 2 to 3 inches from the wall to allow space for opening the lid. Still further, external hinges add to shipping costs, inasmuch as packing is required around the hinges and the hinges add to the floor space (in, e.g., a rail car) required for each freezer.

Some hinges of the prior art have been mounted within the unit to avoid the above problems. However, these hinges have introduced yet another problem when used in freezers—they adversely impact on the insulation of the freezer, with the hinge components often acting as thermal conductors across insulating gaps to increase the energy costs of the freezer.

A number of both internal and external hinges such as discussed above have been provided with biasing mechanisms to counterbalance the weight of the lid to ease its opening. In addition to the respective problems of the prior art internal and external hinges as discussed above, many prior art hinges having such biasing mechanisms have had a further problem in that they introduce undesirable stresses (e.g. non-rotational stresses) in the unit (e.g. freezer). These stresses are often such that freezer manufacturers must design additional strength into their lids and chests simply so that their freezers will be able to withstand the hinge-caused stresses. Further, the prior art counterbalancing hinges have been bulky so that, even if mounted "internally", they have required either that the "internal" space be enlarged or that access to the unit be hindered, in both cases undesirably affecting the unit.

The present invention is directed toward overcoming one or more of the problems as set forth above.

SUMMARY OF THE INVENTION

In one aspect of the present invention, a concealed hinge between the lid and chest of a freezer is disclosed having a hook shaped support bracket with a leg and bight. The bracket leg is mounted within one wall of the chest and the bight defines substantially diametrically opposed first and second pivots. A mounting structure is provided to pivotably secure the lid to the first pivot of the support bracket. A fixed point is defined within the lid and a compression spring member is provided between the fixed point and the second pivot of the bracket.

In another aspect of the present invention, the bracket leg is mounted within the chest wall by plastic components which function as a thermal barrier.

One object of the present invention is to provide a concealed hinge for a freezer to enhance the appearance of the freezer and to simplify and reduce the cost of shipping and handling of such freezers.

Another object of the present invention is to provide freezer hinges which do not adversely effect the insulation of the freezer, and which thereby help to minimize the energy costs of the freezer.

Yet another object of the present invention is to provide a counterbalancing hinge which eases the opening of the freezer lid and which does not introduce undesirable forces in the freezer so that the freezer manufacturer is not required to design additional strength into their lids and chests to withstand such forces.

BRIEF DESCRIPTION OF THE DRAWINGS

FIG. 5 is a view similar to FIG. 1 but showing an alternative embodiment of the present invention;

FIG. 6 is a partial cross-sectional view from the right in FIG. 5; and

FIG. 7 is a partially broken away view of the embodiment of FIG. 5 as viewed from the top.

DESCRIPTION OF THE PREFERRED EMBODIMENTS

Figure 1:
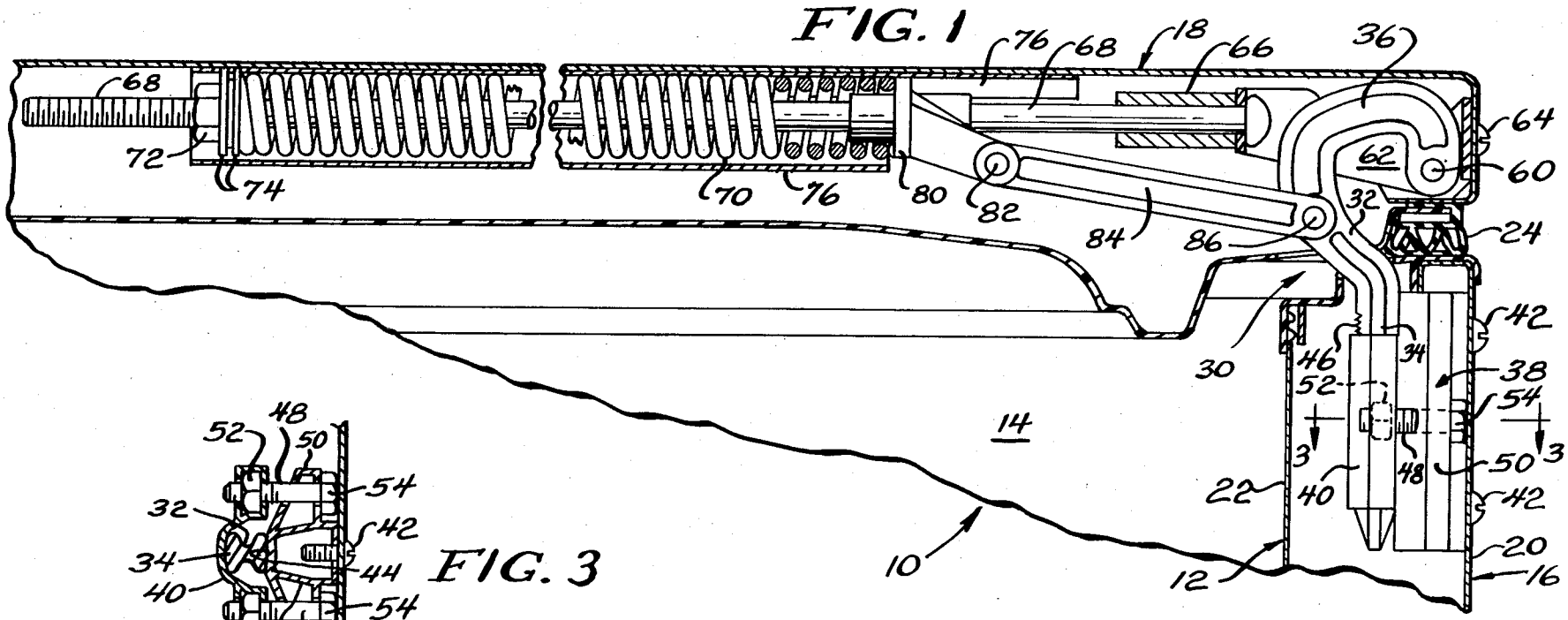
FIG. 1 is a cross-sectional view through a freezer showing one embodiment of the present invention.
Figure 2:
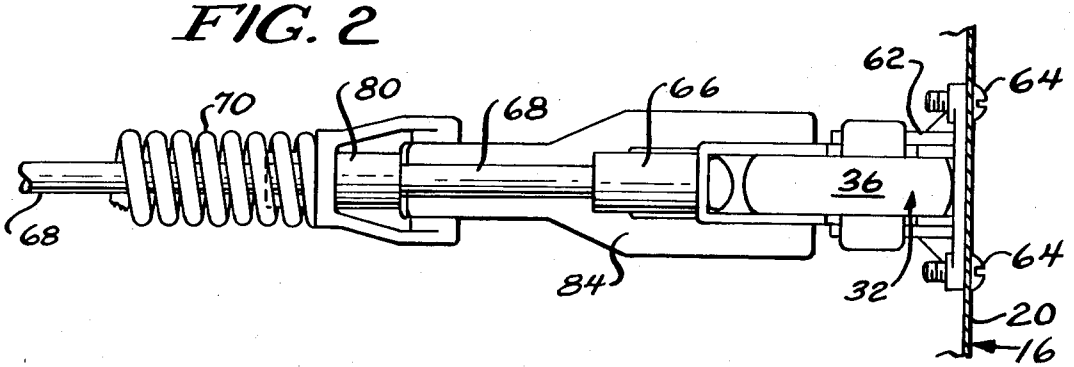
FIG. 2 is a partial view of the hinge from the top in FIG. 1.

The present invention relates to hinges for freezers. In FIG. 1, a portion of a freezer 10 is shown, including a rear wall 12 and a side wall 14 (in the background) of the chest 16 and a lid or closure 18 thereon. The walls 12,14 and lid 18 are, of course, suitably insulated to function as a thermal barrier against ambient temperatures. The insulation (not shown) is typically located between two sheets 20,22 of waterproof material (such as metal) which protect the chest 16 and enhance its appearance. A sealing member 24 extends around the bottom periphery of the lid 18 such that, when the lid 18 is closed, the sealing member 24 will engage the upper rim of the chest 16 to totally enclose the cold chamber or chest interior.

One embodiment of a concealed hinge 30 of the present invention is shown in FIGS. 1–4. While reference hereafter is to a single hinge 30, it should be understood that most freezers 10 require at least two such hinges.

The hinge 30 includes a support bracket 32 substantially in the shape of a question mark with a leg 34 and a bight 36. It is preferred that the support bracket 32 be made of a suitable metal which will provide the strength and durability required in such a hinge 30. Zinc is one metal which is known to be sufficient.

Figure 3:
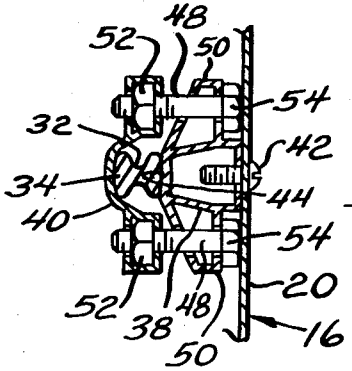
FIG. 3 is a cross-sectional view taken along line 3—FIG. 1.

The support bracket 32 is secured within the rear wall 12 of the chest 16 by a base member 38 and a clamp member 40, both of which are made of insulating polyvinyl cloride (PVC) plastic. Specifically, as best illustrated in FIGS. 1 and 3, the base member 38 is suitably secured to the outer sheet 20 of the rear wall 12, as by the screws 42 shown. The base member 38 includes a longitudinal pocket 40 against which the support bracket leg 34 is clamped to secure it thereto. Preferably, the support bracket leg 34 has serrations 46 to prevent it from slipping with respect to the clamp member 40. Bolts 48 extend through side flanges 50 of the base member 38 and are tightened with associated nuts 52 in the clamp member 40 to clamp the two together. The side flanges 50 preferably are recessed to prevent the heads 54 of the bolts 48 from directly contacting the rear wall outer sheet 20 (note the small gap in FIG. 3).

This inexpensive and easy to assemble mounting structure has no metal-to-metal contact, and thus maintains the integrity of the insulation of the freezer 10.

The end of the bight 36 of the support bracket 32 defines a pivot 60 which is rotatably secured to a pivot bracket 62 by, for example, a rivet. The pivot bracket 62 is suitably secured to the lid 18, as by the screws 64 shown. The pivot bracket 62 includes a neck portion 66 and a tie rod 68 projects forwardly therefrom toward the front of the lid 18. Though the tie rod 68 may be secured against the top of the lid 18, it need not be as it is biased against the top of the lid 18 to maintain it in that position in any event (as will become apparent).

A compression spring 70 extends over the rod 68 and on one end abuts a shoulder defined by a nut 72 and washers 74. The nut 72 can be adjusted according to the particular freezer 10 requirements (e.g. lid weight).

Figure 4:
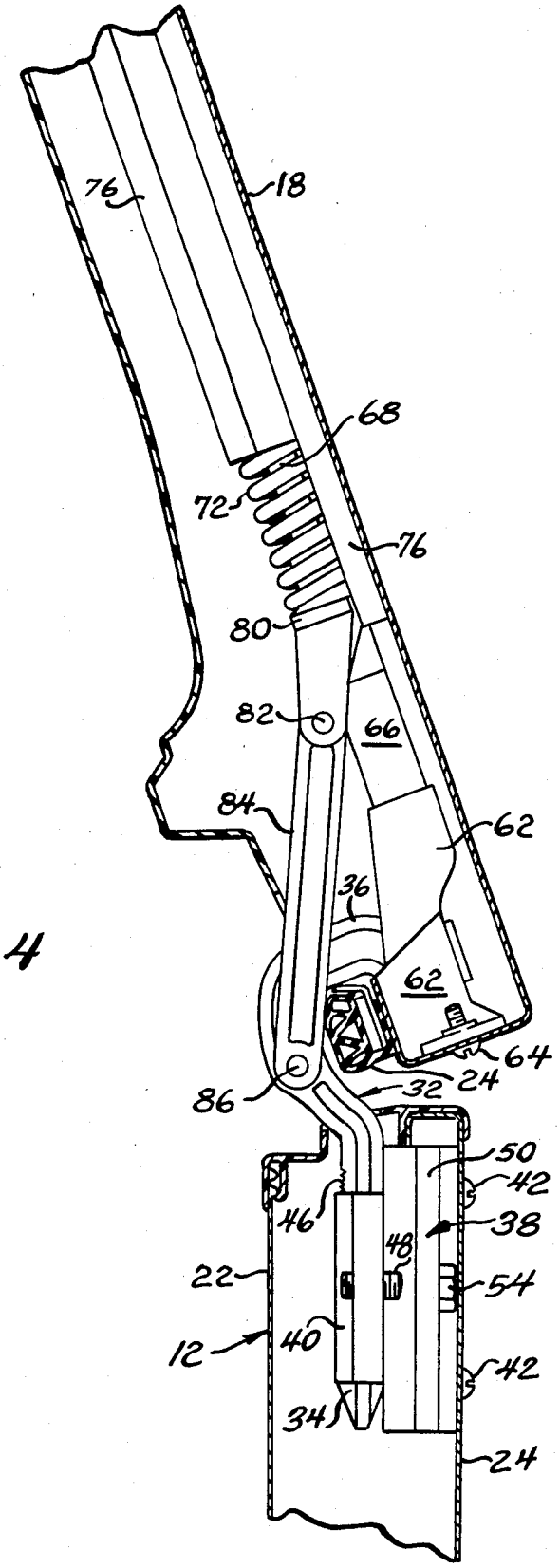
FIG. 4 is a view of the hinge of FIG. 1 when opened.

A spring container 76 is disposed around the spring 70 (as best shown in FIG. 4) and is thereby biased against the top of the lid 18 to protect the spring 70 and to uniformly apply the rotational hinge forces to the lid 18 as will become apparent. The spring container 76 may be made of aluminum to provide strength and durability.

The opposite end of the spring 70 abuts a collar 80 which is slidably received over the rod 68. The collar 80 further defines a pivot 82 rotationally connected to a link 84 which on its other end is rotationally connected to a second bight pivot 86 which is substantially diametrically opposed from the first bight pivot 60.

During assembly of the hinge 30 to the freezer 10, the link 84 can be disconnected from the second bight pivot 86 to release the force of the spring 70 from the hinge 30. The link 84 can then be reconnected to the pivot 86 after the hinge 30 is secured to both the chest 16 and lid 18.

It will be understood by a skilled artisan that this hinge 30 tends to bias the lid 18 clockwise about the support bracket 32 as viewed in FIG. 1 toward an open position. Thus, the weight of the lid 18 can be counterbalanced so that the lid 18 can be opened with almost no effort. Further, by suitably balancing the weight of the lid 18, an overcenter type of operation can be provided in which the hinge 30 will support the lid 18 in its open position such as shown in FIG. 4 (even though the lid 18 is pivoted less than 90°). Pivoting of the lid 18 is limited by the abutment of the neck portion 66 with the collar 80 as shown in FIG. 4.

Still further, only the rotational force of the hinge 30 is transmitted to the freezer chest 16. All of the non-rotational forces are contained completely within the hinge 30, thereby allowing freezer manufacturers to be unconcerned about additional lid 18 and chest 16 strength requirements which are important to many prior art hinges.

The concealment of the hinge 30 further provides numerous advantages. The hinges 30 do not interfere when the freezer 10 is moved through doorways (often prior art exposed hinges must be removed to fit through doorways, a dangerous requirement for hinges under pressure). Also, the concealed hinges 30 of the present invention allow the freezer 10 to be located near walls (whereas some prior art hinges require two to three inch clearance). Further, reduced shipping costs result since less packing material is required and more freezers 10 can be fit in a given floor space (e.g. rail car).

The hinge 30 of the present invention still further minimizes any adverse impact on the insulating characteristics of the freezer 10. Specifically, almost all parts contacting other surfaces of the freezer 10 may be made of PVC plastic which, of course, has low thermal conduction. The one exception is the spring container 76 which is isolated from metal parts in and adjacent the cold chambers by other plastic components (e.g. link 82 and pivot bracket 62). Further, the hinge 30 can be placed near to the side walls 14 of the freezer 10 to allow maximum insulation between the cold chamber and the hinge 30. Still further, the bight 36 of the support bracket 32 does not interfere with the sealing member 24 when the lid 18 is opened (as shown particularly in FIG. 4), enabling a tight, uninterrupted seal to be provided around the lid 18.

Another embodiment of the hinge 30' is shown in FIGS. 5–7. This hinge 30' includes a support bracket 32 mounted within the rear wall 12 as with the first embodiment, and thus like components have been given like reference numerals.

This hinge 30' includes a modified pivot bracket 62' rotatably securing the lid 18 to the first bight pivot 60. That pivot bracket 62' is further suitably secured to a pair of beam members 90 by, for example, the rear rivets 92 and shear studs 94 shown. The beam members 90 are essentially spaced vertical plates extending forwardly within the lid 18'.

A suitable gas spring 96 is supported at one end on a pivot 98 between the beam members 90 (said pivot 98 defining a fixed point within the lid 18') and at the other end to the second bight pivot 86'. The gas fill ratio of the gas spring 96 can be selected according to the biasing force desired for the particular lid 18'.

This gas spring hinge 30' uses somewhat fewer parts than the first described embodiment and yet provides the same advantages as that embodiment. Further, the gas spring 96 provides very high reliability within the present invention inasmuch as it is fully contained within the stable environment of the freezer lid 18'. Highly reliable gas springs are available on the market having, for example, only 5% loss of gas spring force after 188,000 cycles and 3–4% static loss over 10 years (all of which can, of course, be designed into the original assembly).

Also, this gas spring hinge 30' can be used in virtually any freezer without requiring different size components (the only change required being the gas charge in the spring 96). Further, the gas spring 96 can be selected to provide a damping feature and a cushioned end motion to provide smooth opening motion and prevent shock, respectively.

Other aspects, objects and advantages of the present invention can be obtained from a study of the drawings, the specification and the appended claims.

I claim:

1. A concealed hinge between the lid and the chest wall of a freezer, comprising:

a hook-shaped support bracket having a leg and a bight, said leg being adapted for mounting within the chest wall and said bight defining substantially diametrically opposed first and second pivots and being substantially within the lid when the lid is closed;

a rigid member pivotably mounted at one end to the first pivot and at the other end defining a fixed point within the lid at a selected radial distance from the first pivot;

means for mounting the lid to the rigid member; and a compression spring member extending between the fixed point and the second pivot.

2. The hinge of claim 1, wherein the spring member comprises:

a biasing leg having one end pivotably secured to the second pivot; and a mechanical compression spring over the rigid member, one end of the spring being secured at the fixed point and the other end of the spring being connected to the other end of the biasing leg.

3. The hinge of claim 1, wherein the spring member is a gas spring.

4. The hinge of claim 1, wherein the support bracket leg is mounted to the chest by a thermal barrier comprising a plastic base member secured to the chest wall by metal screws, and a plastic clamp member secured to the base member, said base and clamp members defining a pocket therebetween adapted to fix the bracket leg relative to the chest wall without contacting the leg to the metal screws.

5. The hinge of claim 1, wherein the lid has a seal therearound engaging the chest when closed and the opening in the support bracket bight is adapted to receive the lid seal when the lid is opened.

6. A concealed hinge for a closure of a heat insulated chest, comprising:

a support bracket having a leg mounted within a wall of the chest and having a bight extending from the chest and being substantially enclosed within the closure, said bight defining first and second pivots;

a pivot bracket rotatably secured to the first pivot and extending through the closure to define a fixed point therein;

means for mounting the closure to the pivot bracket;

a link member having an end rotatably secured to the second pivot; and means for biasing the link member end away from the fixed point within the closure.

7. The hinge of claim 6, wherein the biasing means is a gas spring.

8. The hinge of claim 6, wherein the support bracket leg is mounted to the compartment by a thermal barrier comprising a plastic base member secured to the chest by metal screws, and a plastic clamp member secured to the base member, said base and clamp members defining a pocket therebetween adapted to fix the support bracket leg relative to the chest without contacting the leg to the metal screws.

9. The hinge of claim 6, wherein the closure has a seal therearound engaging the chest when closed and the support bracket bight includes an opening between the first and second pivots, said opening being adapted to receive the closure seal when the closure is open.

10. The hinge of claim 6, wherein the pivot bracket includes a tie rod projecting forwardly in the closure from the support bracket, said tie rod defining the fixed point.

11. The hinge of claim 10, wherein the biasing means comprises a compression spring over the tie rod and between the fixed point and the link member.

12. A concealed freezer hinge between the lid and the chest wall of a freezer, comprising:

a hook-shaped support bracket having a leg and a bight, said bight being substantially within the lid when the lid is closed and defining substantially diametrically opposed first and second pivots;

a plastic base member secured to the freezer wall by metal screws, and a plastic clamp member secured to the base member, said base and clamp members defining a pocket therebetween adapted to fix the support bracket leg relative to the freezer wall without contacting the leg to the metal screws;

a pivot bracket secured to the lid and to the first pivot of the support bracket;

a tie rod secured to the pivot bracket and extending within the lid to define a fixed point therein;

a compression spring member extending between the fixed point and the second pivot; and a seal around the lid engaging the chest when closed, the opening in the support bracket bight being adapted to receive the lid seal when the lid is opened.

* * * * *